US005651312A

United States Patent [19]

Borghesan

[11] Patent Number: 5,651,312

[45] Date of Patent: Jul. 29, 1997

[54] PRINTING PRESS WITH DEVICE FOR RAPID REPLACEMENT OF THE INKING UNIT CYLINDER LINERS

[75] Inventor: Roberto Borghesan, Milan, Italy

[73] Assignee: Bielloni Castello S.p.A., Milan, Italy

[21] Appl. No.: 626,042

[22] Filed: Apr. 1, 1996

[30] Foreign Application Priority Data

Apr. 12, 1995 [IT] Italy ..... MI95A0752

[51] Int. Cl.[6] ..... B41F 5/00

[52] U.S. Cl. ..... 101/216; 101/181

[58] Field of Search ..... 101/138, 178, 101/181, 216, 219, 375, 218

[56] References Cited

U.S. PATENT DOCUMENTS

| | | | |
|---|---|---|---|
| 4,119,032 | 10/1978 | Hollis | 101/216 |
| 4,823,693 | 4/1989 | Kobler | 101/375 |
| 4,913,048 | 4/1990 | Tittgemeyer | 101/216 |
| 5,005,475 | 4/1991 | Knauer | 101/218 |
| 5,241,905 | 9/1993 | Guaraldi et al. | 101/216 |
| 5,342,905 | 8/1994 | Guaraldi et al. | 101/216 |
| 5,458,061 | 10/1995 | Koura et al. | 101/216 |

FOREIGN PATENT DOCUMENTS

| | | |
|---|---|---|
| 0 549 936 | 7/1993 | European Pat. Off. . |
| 2102733 | 2/1983 | United Kingdom . |

OTHER PUBLICATIONS

Printing World, Apr. 5, 1979, vol. 202, No. 14 "Dual Process Label Printing".

*Primary Examiner*—Ren Yan

*Attorney, Agent, or Firm*—Brooks & Kushman P.C.

[57] ABSTRACT

A printing press, in particular for flexographic printing, comprising an unwinder (4) for unwinding a roll (6) of sheet material (8) to be printed and a winder (5) for winding a roll (6) of printed sheet material, which is conveyed round a drum (14) along the periphery of which is distributed a plurality of inking units (12), each comprising an inking or anilox cylinder (13) and a printing or plate cylinder (14), both the drum (10) and the cylinders (13, 14) of each inking unit (12) being supported by a pair of sides (11), at least one of said sides (11) being provided with at least one mobile shoulder (15) that can turn around a hinge (16), so that it can be brought from a closed operating position in which it co-operates in supporting said inking units (12), to an open position in which it completely frees the cylinder (13, 14) of the inking traits (12) which continue to be supported in cantilever by the other side (11).

5 Claims, 2 Drawing Sheets

PRINTING PRESS WITH DEVICE FOR RAPID REPLACEMENT OF THE INKING UNIT CYLINDER LINERS

FIELD OF INVENTION

The present invention relates to a printing press, particularly for flexographic printing, provided with a device for rapid replacement of the inking unit cylinder liners.

BACKGROUND OF INVENTION

As is known, a printing press of the above type essentially comprises a drum of considerable diameter around which the sheet material for printing is conveyed, said sheet material being unwound from an unwinding roll and rewound, after printing, onto a winding roll.

Depending upon the pattern to be printed on the sheet material, that is according to the number of colours to be transferred onto it, a plurality of inking units is disposed along the periphery of said drum, each comprising an inking or anilox roller, which picks up the ink from a special tank by means of special cuts or cells in its skirt and transfers it to a printing cylinder proper, or plate cylinder, which carries out printing on the sheet material.

In such a printing press the inking traits, or at least the print cylinders, must be replaced each time the pattern to be printed changes.

The cylinder replacement operation is rather long and laborious since these are normally supported between the two sides of the machine.

Complete removal of such cylinders thus entails releasing their ends from the sides of the machine and using hoists to handle them.

In order to avoid complete replacement of the cylinders, which is also very costly, systems have recently been proposed that provide for removal only of the outer liner of the cylinders.

A known arrangement consists of swinging the support of one end of the cylinder outwards and raising the cylinder axle, in order to have enongh room to slip off the liner. According to this method only the print cylinder, and not the inking or anilox cylinder, is normally removed.

Another method known to the art consists in sliding the cylinder supports upward along the sides of the press, so that their liners can then be slipped off horizontally.

This method holds the drawback of having to work in a somewhat limited space to slip off the cylinder liners, and having to work on one cylinder assembly at a time. Moreover, making the cylinder supports mobile weakens the press structure.

The aim of the invention is to overcome the above drawbacks, providing a device that allows easy and rapid replacement of the inking unit cylinder liners, with ample space for access to them.

Another aim of the invention is to provide a device of this type that leaves the sturdiness of the press virtually unaltered.

These aims are achieved by the press according to the invention which has the characteristics listed in the attached claim 1.

Preferred embodiments of the invention are disclosed in the dependent claims.

Essentially, at least a mobile shoulder is provided on at least one of the two sides of the press supporting the counter drum and the inking units, it being possible to move said shoulder from a closed position in which it supports the inking cylinders to an open position in which it simultaneously releases all the inking cylinders associated with it. Suitable mechanisms are provided to release the supported ends of the inking unit cylinders, in order to prevent them from interfering with the movement of the mobile shoulder during opening and closing.

SUMMARY OF THE INVENTION

In this manner, when said mobile shoulder is in the open position, free access is available to the inking unit cylinders, which are supported in cantilever by the other side of the press, in order to carry out replacement of the liners.

Further characteristics of the invention will be made clearer by the detailed description that follows, referring to a purely explemplary and therefore not limiting embodiment, illustrated in the annexed drawings in which:

BRIEF DESCRIPTION OF PREFERRED EMBODIMENTS

Figure 1:
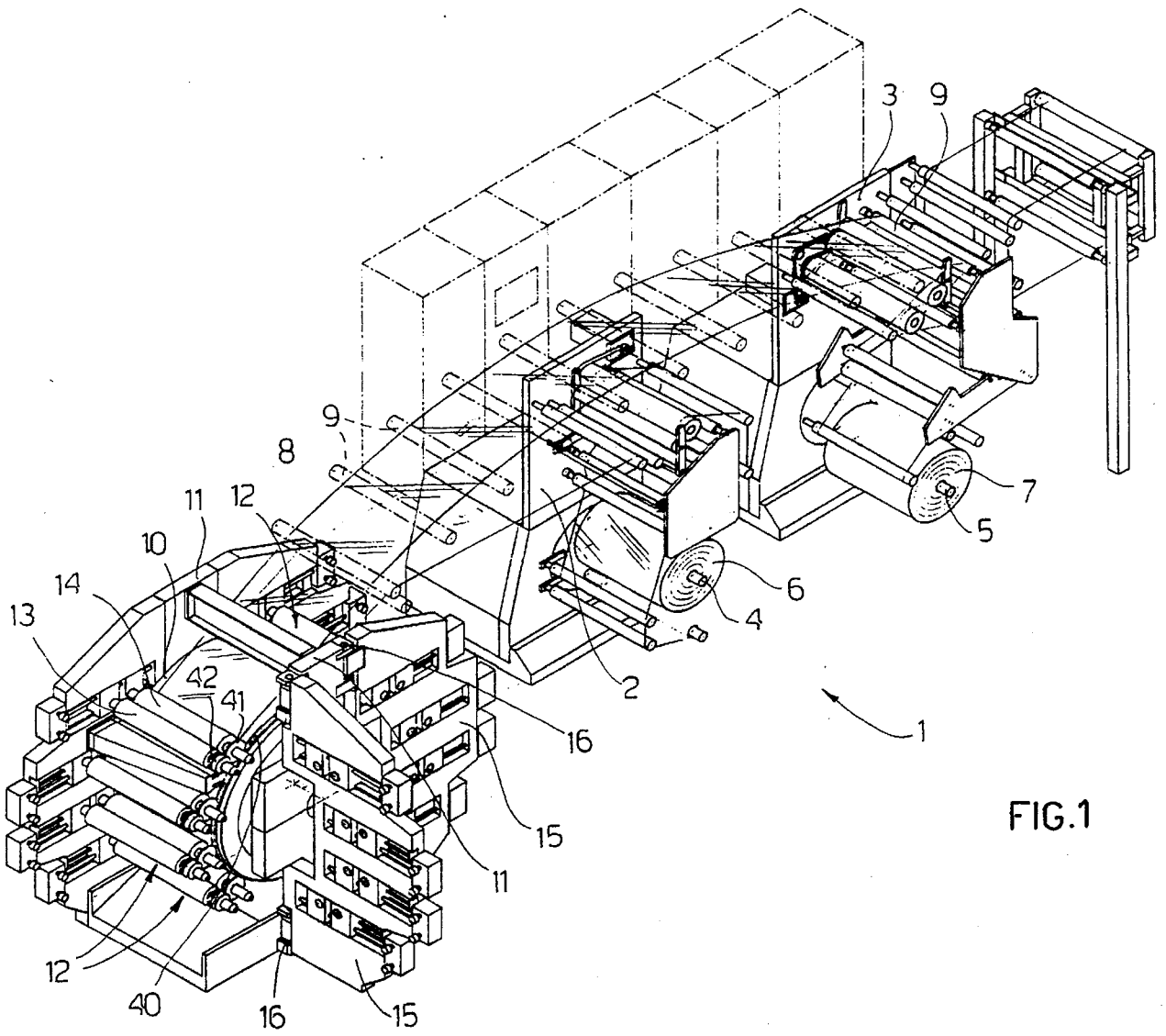
FIG. 1 is a schematic axonometric view of a printing press according to the invention.

With reference to FIG. 1, reference numeral 1 indicates a printing press as a whole, in particular for flexographic printing, comprising, on one side, a pair of supporting frames 2, 3, respectively bearing an unwinder 4 for a roll 6 of sheet material 8 for printing, and a winder 5 for a roll 7 on which the sheet material is rewound after printing, passing over a plurality of idle rollers, generically indicated by reference number 9. The sheet material 8 unwound from the roll 6 is conveyed around a large-diameter drum 10, acting as a counter element during printing. The drum 10 is supported by a pair of opposite sides 11, between which are also supported the inking units, generically indicated by 12, distributed along the periphery of the drum 10, their number depending upon the number of colours to be transferred to the sheet material 8.

In the example shown in FIG. 1 eight inking units are provided, distributed four on one side and four on the other side of the drum 10.

Each inking trait 12 comprises an inking cylinder 13, also called anilox cylinder and a print cylinder or plate cylinder 14, set between the cylinder 13 and the drum 10.

Each anilox cylinder 13, in a per se known manner, has cuts or cells on its outer surface and collects ink from a respective tray beneath it, not shown in the annexed figures, transferring the ink to the print cylinder 14, bearing the plate corresponding to the pattern to be printed, which in turn transfers the colour to the sheet material 8 which advances in the direction of the arrows indicated in FIG. 1.

Each inking unit 12 obviously transfers one colour onto the sheet material 8 so that the pattern is completed when that portion of the sheet leaves the drum 10.

Obviously, the machine is much more complicated than what is described, in that dryers are provided, for example, between one inking unit and the next, so as to dry the colour that has just been printed before the next is applied. However, all this lies outside the subject matter of the invention, which will now be described in greater detail.

As can be seen in FIG. 1, two mobile shoulders 15 are provided on one of the sides 11, balancing around respective hinges 16 with a vertical axis. In the claims the mobile shoulders 15 are referred to as hinged portions or swingable portions of the side plate 11.

One of the mobile shoulders 15 is shown in the closed position in FIG. 1, while the other is in open position, giving free access to the cylinders of the corresponding four inking units 12 which continue to be supported by the other side 11 from which they project.

It is obvious from FIG. 1 that the operation of slipping off the cylinder liners is considerably facilitated and can take place with simple and rapid operations, the operator being completely free in his movements. It is also possible to remove the liners of both cylinders 13, 14 of each inking unit, when this is required by a change in production.

The printing press according to the invention is therefore particularly suitable for short or very short runs, whilst it can still be used advantageously even for long runs and can be managed by a single operator.

Figure 2:
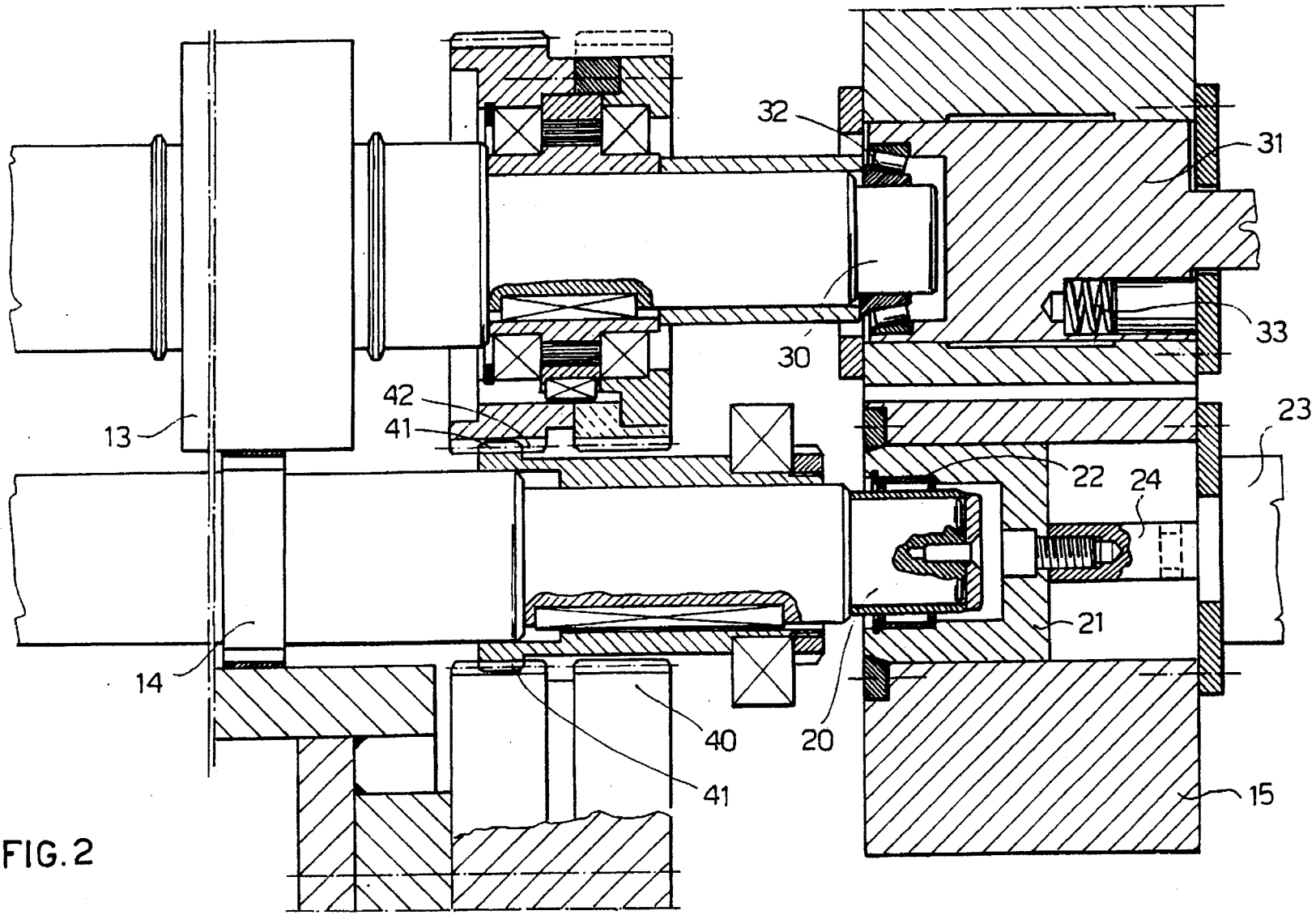
FIG. 2 is a section taken at the ends of the cylinders of an inking unit, supported by a mobile shoulder.

Referring now to the cross section in FIG. 2 in particular, the means that allow the shoulders 15 to be opened and closed without their movement being hampered by the ends of the inking unit cylinders will be described briefly.

The end 20 of the printing cylinder 14, which is normally mounted so that it can be moved axially in order to regulate printing, is seated in a cylindrical support 21 with a bearing 22, said support 21 being mounted so that it can slide axially in the shoulder 15, under the control of a respective pneumatic cylinder 23. Operation of the cylinder 23 causes withdrawal of the support 21, by means of the respective piston 24 fixed to the latter, thus releasing the end 20 of the cylinder 14, so as not to hamper the opening and closing movements of the shoulder 15.

The end 30 of the anilox cylinder 13, which, on the other hand, is mounted in an axially fixed manner, is supported by a support 31 with a cone bearing 32, said support being elastically pushed by springs 33 against the end 30 of the cylinder 13. Provision of the cone bearing 32 prevents the end 30 of the cylinder 13 from interfering with the opening and closing movements of the shoulder 15.

Once the shoulder 15 is opened, the liners of the cylinders 13 and 14 are slipped off, an operation which can be considered conventional.

Together with the liners of these cylinders, the cylinder driving gear is also removed.

As can be seen in these figures, a cogwheel 40 is provided on the drum 10 and engages with a cylindrical gear 41 provided on the print cylinder 14, in turn engaging with a cylindrical gear 42 borne by the anilox cylinder 13. Clearly the gears 41, 42 must be removed together with the liners of the respective cylinders 14 and 13 each time the print development has to be changed.

From what is described the advantages of the invention are obvious, in that it allows rapid and easy replacement of the cylinder liners of the inking units, thus allowing easy changes of production in printing presses, particularly for flexographic printing.

I claim:

1. In a printing press having an unwinder for unwinding a roll of sheet material to be printed, a winder for winding a roll of printed sheet material, a counter drum around which the sheet material is wrapped for printing with a plurality of inking units arranged about the periphery of the drum and each comprising an inking cylinder and a printing cylinder for printing on the sheet material wrapped on the drum, such cylinders having liners thereon which are removable endwise therefrom, and a pair of side plates overlying and supporting opposite ends of the counter drum and the inking units, characterized in that at least one of the side plates of said pair has a hinged portion swingable from a position overlying and supporting an end of the inking units to a position remote from such end of the inking units whereby access to such end of the inking units may be gained for allowing the liners on the cylinders thereof to be removed endwise, and wherein a support is mounted in the swingable side plate portion movable axially of the printing cylinder of each inking unit and provided with a bearing supporting the adjacent end of the printing cylinder, and a linear actuator connected to said support for moving the same axially.

2. The invention defined by claim 1 wherein a cogwheel is provided on the counter drum, and driving gears meshing with the cogwheel are mounted on the cylinders of the inking units for endwise removal therefrom, and upon swinging the side plate portion to a position remote from the inking units the driving gears as well as the liners may be removed endwise from the cylinders of the inking units.

3. The invention defined by claim 1 wherein when the side plate portion is swung to a position remote from the end of the inking units, the inking units are cantilever supported by the other side plate of the pair of side plates.

4. The invention defined by claim 1 wherein each of the side plates has two swingable side plate portions each of which supports the ends of the plurality of inking units and is swingable away from the ends to expose the same for removal of the liners on the inking and printing cylinders thereof.

5. In a printing press having an unwinder for unwinding a roll of sheet material to be printed, a winder for winding a roll of printed sheet material, a counter drum around which the sheet material is wrapped for printing with a plurality of inking units arranged about the periphery of the drum and each comprising an inking cylinder and a printing cylinder for printing on the sheet material wrapped on the drum, such cylinders having liners thereon which are removable endwise therefrom, and a pair of side plates overlying and supporting opposite ends of the counter drum and the inking units, characterized in that at least one of the side plates of said pair has a hinged portion swingable from a position overlying and supporting an end of the inking units to a position remote from such end of the inking units whereby access to such end of the inking units may be gained for allowing the liners on the cylinders thereof to be removed endwise, wherein a cone bearing for supporting the adjacent end of the inking cylinder in said swingable side plate portion and spring means are provided for urging the cone bearing toward the end of the inking cylinder.

* * * * *